US010775093B2

(12) United States Patent
Cha et al.

(10) Patent No.: US 10,775,093 B2
(45) Date of Patent: Sep. 15, 2020

(54) REFRIGERATOR

(71) Applicant: LG ELECTRONICS INC., Seoul (KR)

(72) Inventors: Kyunghun Cha, Seoul (KR); Soyoon Kim, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 124 days.

(21) Appl. No.: 15/989,783

(22) Filed: May 25, 2018

(65) Prior Publication Data

US 2018/0340726 A1 Nov. 29, 2018

(30) Foreign Application Priority Data

May 26, 2017 (KR) ..... 10-2017-0065572

(51) Int. Cl.
*F25D 17/06* (2006.01)
*F25D 11/02* (2006.01)
*F25D 25/02* (2006.01)

(52) U.S. Cl.
CPC ..... *F25D 17/065* (2013.01); *F25D 11/02* (2013.01); *F25D 25/025* (2013.01); *F25D 2317/061* (2013.01); *F25D 2317/063* (2013.01); *F25D 2317/066* (2013.01); *F25D 2317/0666* (2013.01); *F25D 2317/0671* (2013.01); *F25D 2400/30* (2013.01)

(58) Field of Classification Search
CPC ..... F25D 17/065; F25D 17/062; F25D 17/06; F25D 17/067; F25D 17/045; F25D 25/025; F25D 11/02; F25D 2317/066; F25D 2317/061; F25D 2317/0666; F25D 2317/0661; F25D 2317/067; F25D 2317/062; F25D 2317/063; F25D 2400/30; F25D 2317/0671
See application file for complete search history.

(56) References Cited

U.S. PATENT DOCUMENTS

2010/0115982 A1* 5/2010 Kim ..... F25D 17/067 62/419
2012/0036879 A1* 2/2012 Candeo ..... F25D 17/045 62/187
2012/0047934 A1* 3/2012 Park ..... F25D 25/024 62/264
2012/0096887 A1* 4/2012 Cho ..... F25D 21/08 62/276

(Continued)

FOREIGN PATENT DOCUMENTS

KR 10-0901033 6/2009

*Primary Examiner* — Emmanuel E Duke
(74) *Attorney, Agent, or Firm* — Ked & Associates, LLP

(57) ABSTRACT

A refrigerator may include a cabinet having a freezer compartment. An evaporator supplies cold air to the freezer compartment and an evaporator cover covers the evaporator. The evaporator cover has a supercooling passage for flowing some of cold air that has exchanged heat through the evaporator to a supercooling compartment of the freezer compartment. A cold air duct directs the other of the cold air that has exchanged heat through the evaporator to a top storage space over the supercooling compartment. A cold air guide device guides cold air in the cold air duct to a bottom storage space under the supercooling compartment.

13 Claims, 14 Drawing Sheets

(56) References Cited

U.S. PATENT DOCUMENTS

| | | | | |
|---|---|---|---|---|
| 2012/0272670 | A1* | 11/2012 | Choi | F25D 23/069 62/89 |
| 2016/0153694 | A1* | 6/2016 | Ko | F25D 17/04 62/186 |
| 2018/0120016 | A1* | 5/2018 | Maxwell | F25D 17/045 |
| 2018/0172331 | A1* | 6/2018 | Tomohiko | F25D 21/006 |

* cited by examiner

REFRIGERATOR

CROSS REFERENCE TO RELATED APPLICATION

This application claims priority under 35 U.S.C. § 119 to Korean Patent Application No. 10-2017-0065572, filed on May 26, 2017, whose entire disclosure is hereby incorporated by reference.

BACKGROUND

1. Field

The present disclosure relates to a refrigerator.

2. Background

In general, a refrigerator is a home appliance that can keep food at a low temperature in a storage space that is closed by a door. A refrigerator may include a freezer compartment and a refrigerator compartment, or a freezer compartment or a refrigerator compartment. The freezer compartment generally may be maintained at a temperature around 18 degrees below zero Celsius.

Refrigerators may include a supercooling compartment that rapidly freezes food by intensively supplying cold air to keep the food fresh. The supercooling compartment may be maintained approximately at a temperature around 35 degrees below zero Celsius. Some of air that has been exchanged heat through an evaporator can be supplied to a freezer compartment through a cold air duct and the other can be supplied to the supercooling compartment through a separate duct.

A grill pan assembly has been disclosed in Korean Patent No. 10-0901033 a supercooling compartment is disposed at the middle portion in a freezer compartment and a freezer duct for discharging cold air is disposed over the supercooling compartment. Cold air is discharged over the supercooling compartment through a plurality of holes formed at the freezer duct and cold air is discharged into the supercooling compartment through an exit formed at the grill pan assembly.

A storage chamber for keeping food may be disposed under the supercooling compartment, and in such a case, the supercooling compartment divides the storage chamber and the space over the supercooling compartment, such that cold air may not be smoothly supplied to the storage chamber. Accordingly, the storage chamber under the supercooling compartment is maintained a higher temperature, so the temperature in the freezer compartment except for the supercooling compartment is not uniform.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
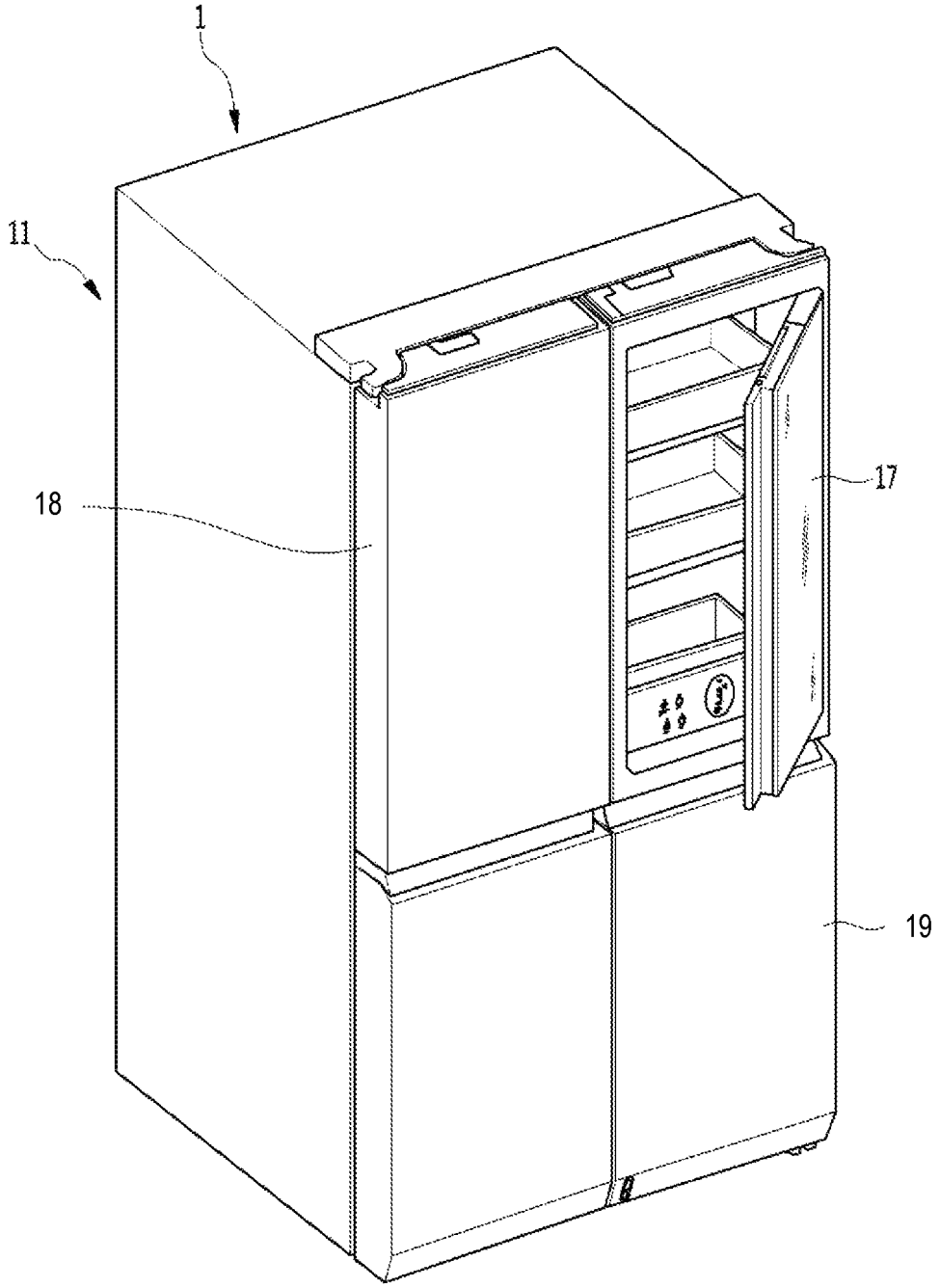
FIG. 1 is a perspective view of a refrigerator according to an embodiment of the present disclosure.

Referring to FIGS. 1 to 4, a refrigerator 1 according to an embodiment of the present disclosure may include a cabinet 11 having a storage chamber and a storage chamber door coupled to the cabinet 11 to open and close the storage chamber. Discharge ducts constituting a cold air guide device are omitted in FIG. 2 for convenience of illustrating an aspect of the present disclosure.

The storage chamber may include a freezer compartment 12 and a refrigerator compartment and objects such as food can be stored in the freezer compartment 12 and the refrigerator compartment. The freezer compartment 12 and the refrigerator compartment can be divided laterally or vertically in the cabinet 11 by a separation wall. A side-by-side refrigerator in which the freezer compartment 12 and the refrigerator compartment are divided laterally by a separation wall is described hereafter.

The storage chamber door may include a freezer door 18 for opening/closing the freezer compartment 12 and a refrigerator door 19 for opening/closing the refrigerator compartment. Though not limited, the refrigerator door 19 may further include a sub-door 17 for taking out the objects stored inside the refrigerator door 19 without the refrigerator door 19 being opened.

A plurality of drawers 13 and 14 for receiving food may be disposed in the freezer compartment 12. The drawers 13 and 14 may include a top drawer 13 and a bottom drawer 14. Though not limited, the top drawer 13 may form a supercooling compartment 15 that is maintained at a lower temperature than the freezer compartment 12. The bottom drawer 14 is disposed under the supercooling compartment 15 and forms a bottom storage space 16. In the embodiment, the space over the supercooling compartment 15 in the freezer compartment 12 may be considered as a top storage space.

A cold air supply mechanism for supplying and circulating cold air in the freezer compartment 12 is provided for the freezer compartment 12. The cold air supply mechanism may include an evaporator 20 and a chamber body 22 forming a heat exchange chamber defining a space for providing the evaporator 20. The evaporator 20 may be provided at a lower space in the chamber body 22. The upper space of the heat exchange chamber forms a passage for flow of cold air passing through the evaporator 20.

The cold air supply mechanism may further include a cold air duct 30 for discharging cold air into the freezer compartment 12 and an evaporator cover 40 may be provided in front of the evaporator 20 to cover the evaporator 20. The evaporator cover 40 is placed under the cold air duct 30. Though not limited, the top of the evaporator cover 40 may be placed under the cold air duct 30.

The evaporator cover 40 may be combined with the chamber body 22. The evaporator cover 40 can guide some of cold air, which has exchanged heat through the evaporator 20, to the supercooling compartment 15.

For example, some of the cold air that has exchanged heat through the evaporator 20 can flow upward in the heat exchange chamber and then can be discharged into the storage space of the freezer compartment 12 by the cold air duct 30. The other of the cold air that has exchanged heat through the evaporator 20 can be supplied directly to the supercooling compartment 15 through the evaporator cover 40.

A supercooling fan (not shown) for blowing cold air to the supercooling compartment 15 may be attached to the evaporator cover 40 (first cover) and may be covered with a cover member 45. The cover member 45 (second cover) may be coupled to the rear side of the evaporator cover 40. The cold air supply mechanism may further include a suction guide 50 for guiding cold air in the freezer compartment 12 to the evaporator 20. The cold air guided by the suction guide 50 flows under the evaporator 20. The cold air supply mechanism may further include a cold air guide device for guiding some of air flowing to the cold air duct 30 to the bottom storage space 16. The cold air guide device may extend downward from the cold air duct 30 and may extend to the bottom storage space 16 through the space behind the supercooling compartment 15.

Figure 11:
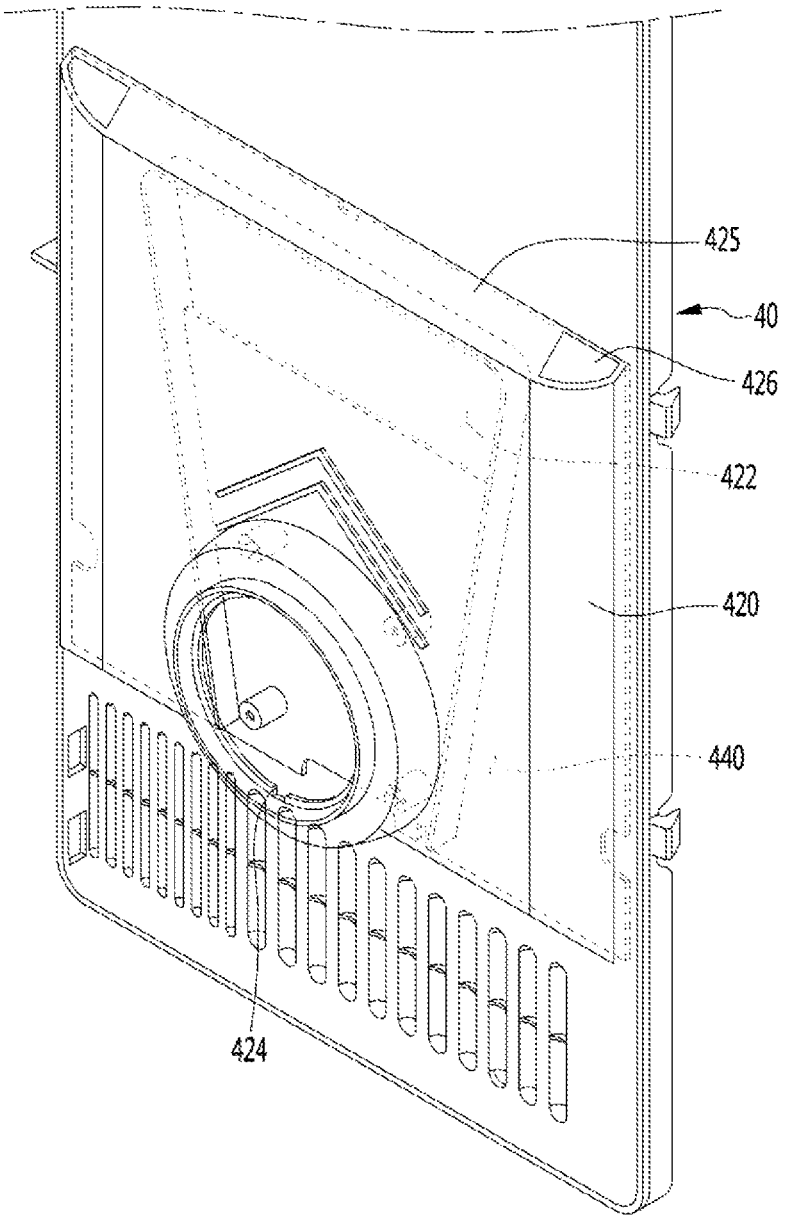
FIG. 11 is a view showing a state in which the cover member is combined with the evaporator cover.
Figure 12:
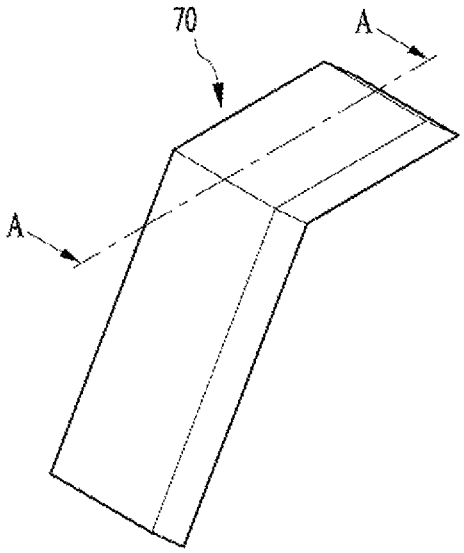
FIG. 12 is a perspective view showing discharge ducts according to an embodiment of the present disclosure.
Figure 13:
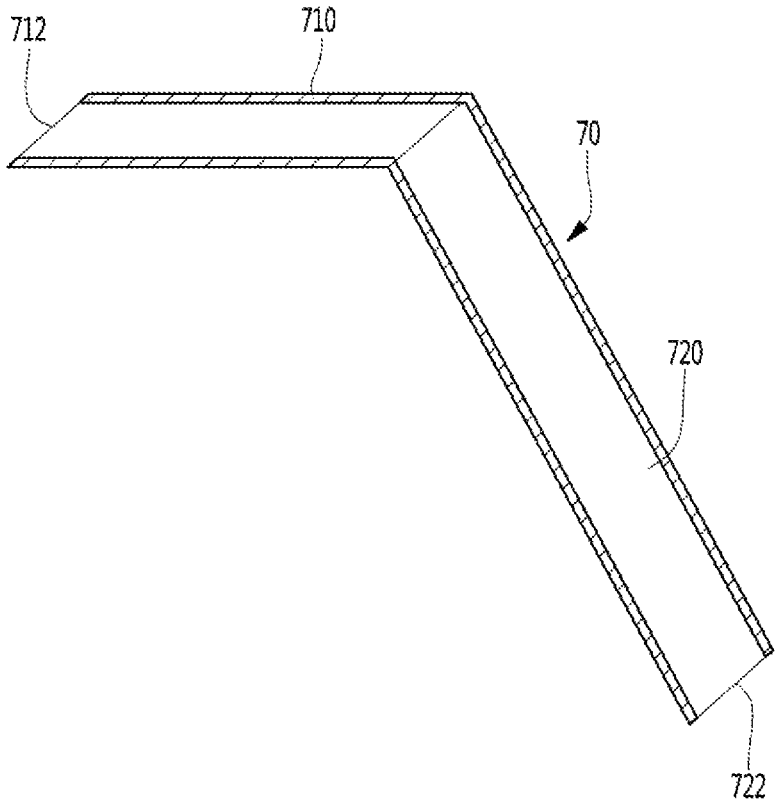
FIG. 13 is a cross-sectional view taken along line A-A in FIG. 12.

The cold air guide device may include a cold air guide 60 connected to the cold air duct 30 to receive cold air and guiding the cold air to the evaporator cover 40, a guide passage 440 (see FIG. 11) formed by the evaporator cover 40, and discharge ducts 70 connected to the evaporator cover 40 and discharging cold air supplied through the guide passage 440 (see FIG. 11) to the bottom storage space 16.

Figure 5:
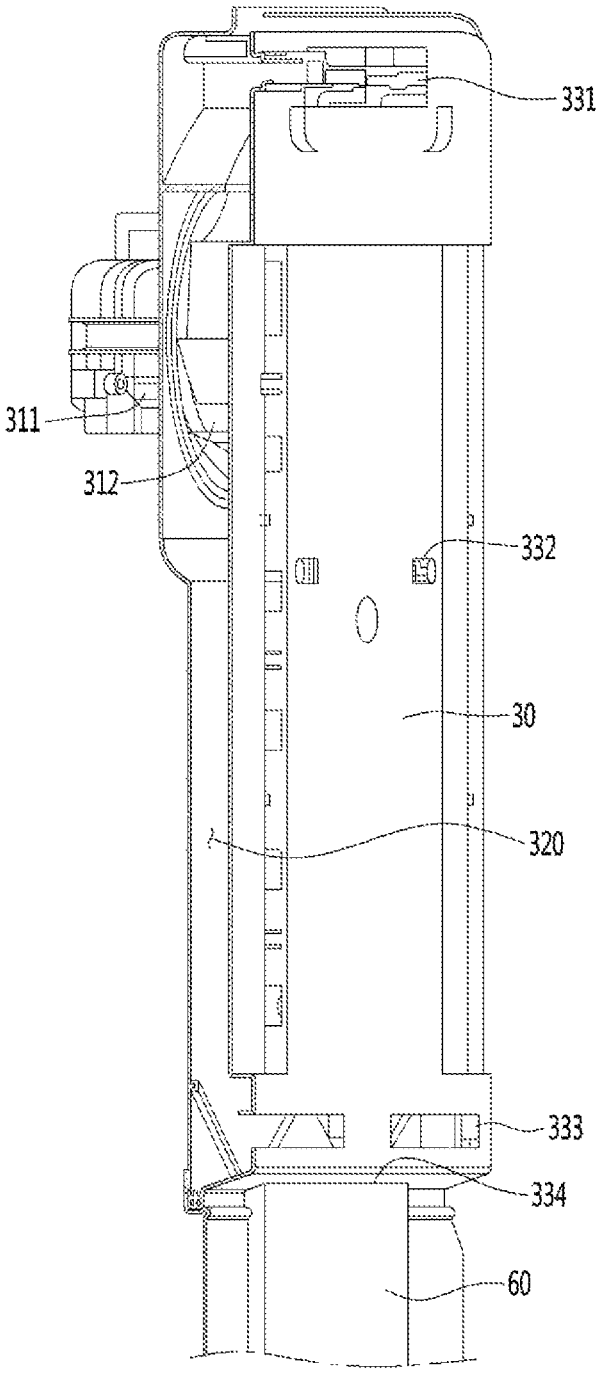
FIG. 5 is a view showing a cold air duct and a cold air guide according to an embodiment of the preset disclosure.

Referring to FIG. 5, a fan motor 311 and a fan 312 that is rotated by the fan motor 311 may be provided in the cold air duct 30.

The cold air duct 30 may have a cold air passage 320 for flow of cold air blown by the fan 312 and a plurality of cold air discharge holes 331, 332, and 333 for discharging cold air in the cold air passage 320. Cold air that has exchanged heat through the evaporator 20 is sent to the cold air passage 320 by the fan 312 and is distributed to the cold air discharge holes 331, 332, and 333 from the cold air passage 320, whereby the cold air is discharged to the freezer compartment 12, in detail, the top storage space.

The cold air discharge holes 331, 332, and 333 may be vertically from each other. Cold air may be uniformly discharged to the top storage space by the cold air discharge holes 331, 332, and 333. The cold air discharge holes 331, 332, and 333, though not limited, may include an upper discharge hole 331, a middle discharge hole 332, and a lower discharge hole 333.

A bottom discharge hole 334 for discharging cold air to the cold air guide device may be further formed through the bottom of the cold air duct 30. The bottom discharge hole 334 may communicate with the cold air guide device. For example, the bottom discharge hole 334 may communicate with the cold air guide 60. A portion of the cold air guide 60 may be inserted in the cold air duct 30 through the bottom discharge hole 334.

Figure 6:
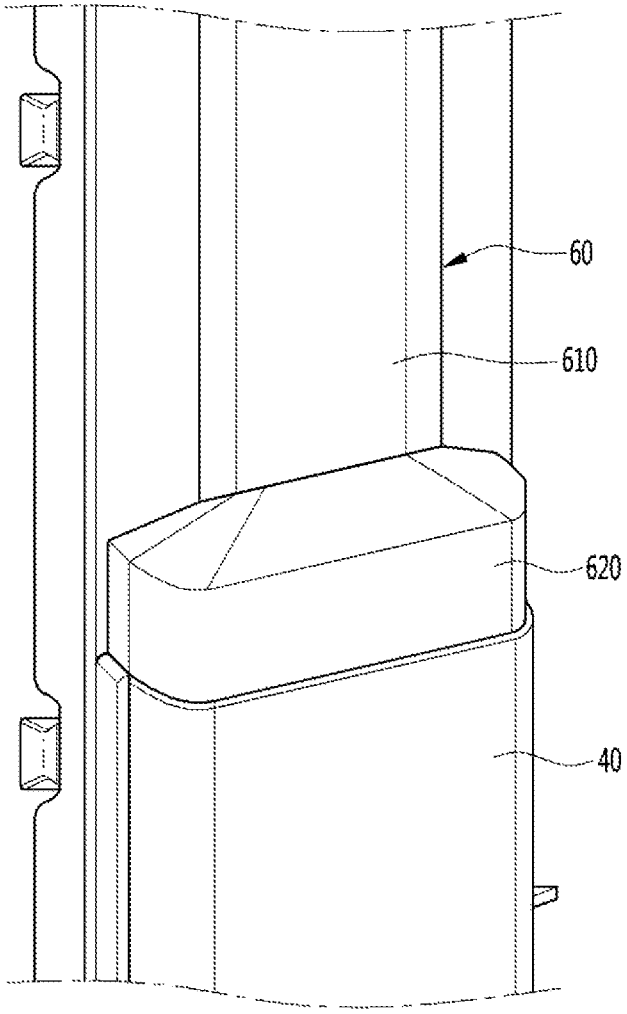
FIG. 6 is a view showing a state in which the cold air guide and an evaporator cover according to an embodiment of the present disclosure communicate with each other.
Figure 7:
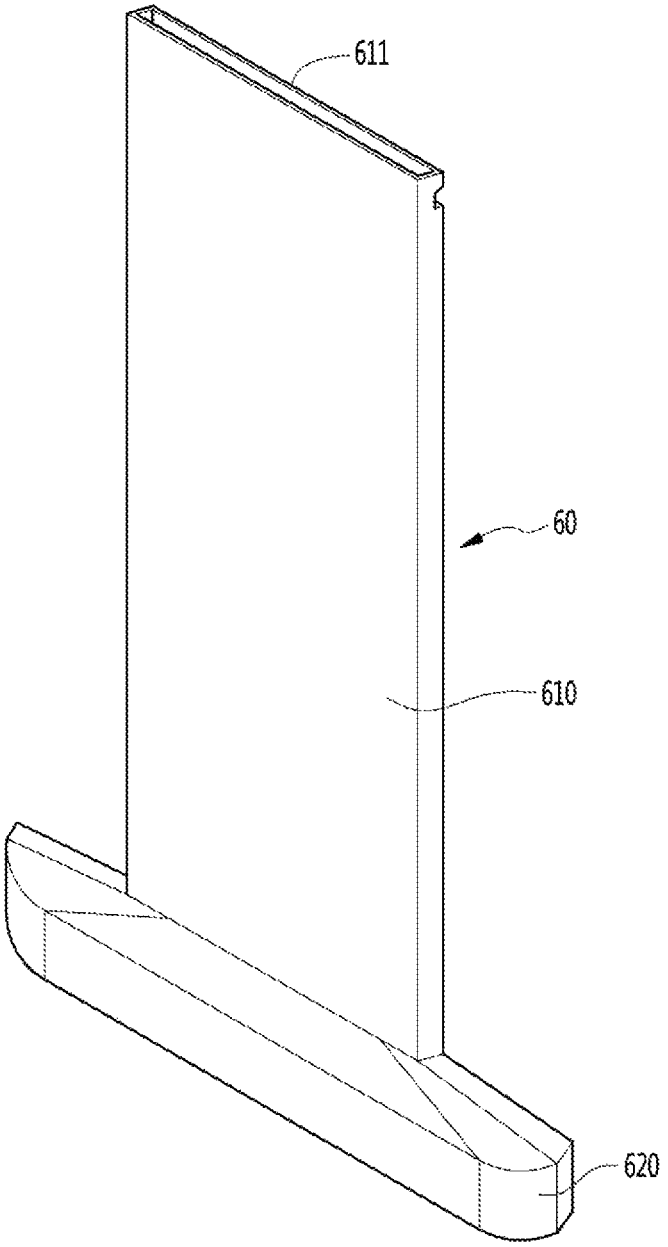
FIG. 7 is a perspective view of the cold air guide according to an embodiment of the present disclosure.
Figure 8:
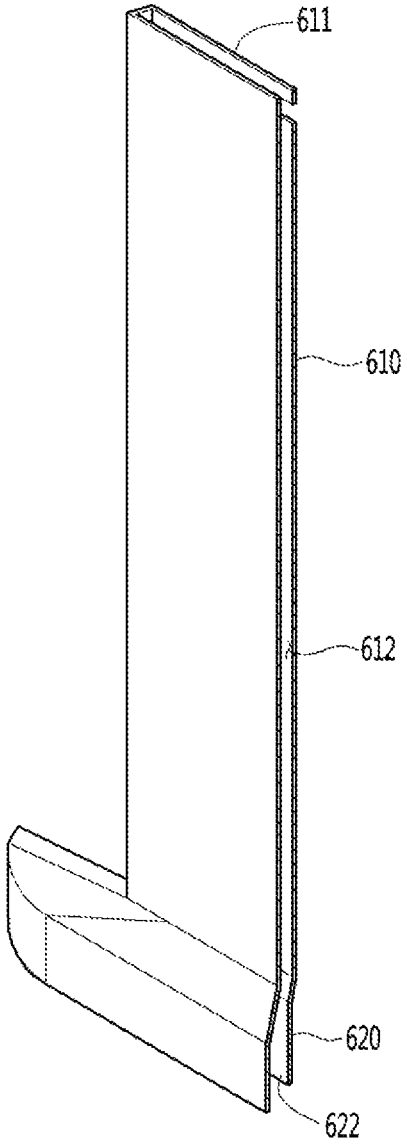
FIG. 8 is a vertical cross-sectional view of the cold air guide of FIG. 7.

Referring to FIGS. 6 and 8, the cold air guide 60 has an inlet 611 and an outlet 622. The inlet 611 of the cold air guide 60 communicates with the bottom discharge hole 334 of the cold air duct 30 and the outlet 622 of the cold air guide 60 communicates with the guide passage 440 (see FIG. 11) formed in the evaporator cover 40.

The cold air guide 60 has a first guide 610 forming a passage 612 and a second guide 620 extending downward from the first guide 610. The inlet 611 is formed at a top surface of the first guide 610 and the outlet 622 is formed at a bottom surface of the second guide 620. The first guide 610 may be formed smaller than the lateral width of the second guide 620. The smaller the width of the first guide 610, the smaller the volume of the first guide 610, so the volume of the freezer compartment 12 can be optimally reduced.

Figure 9:
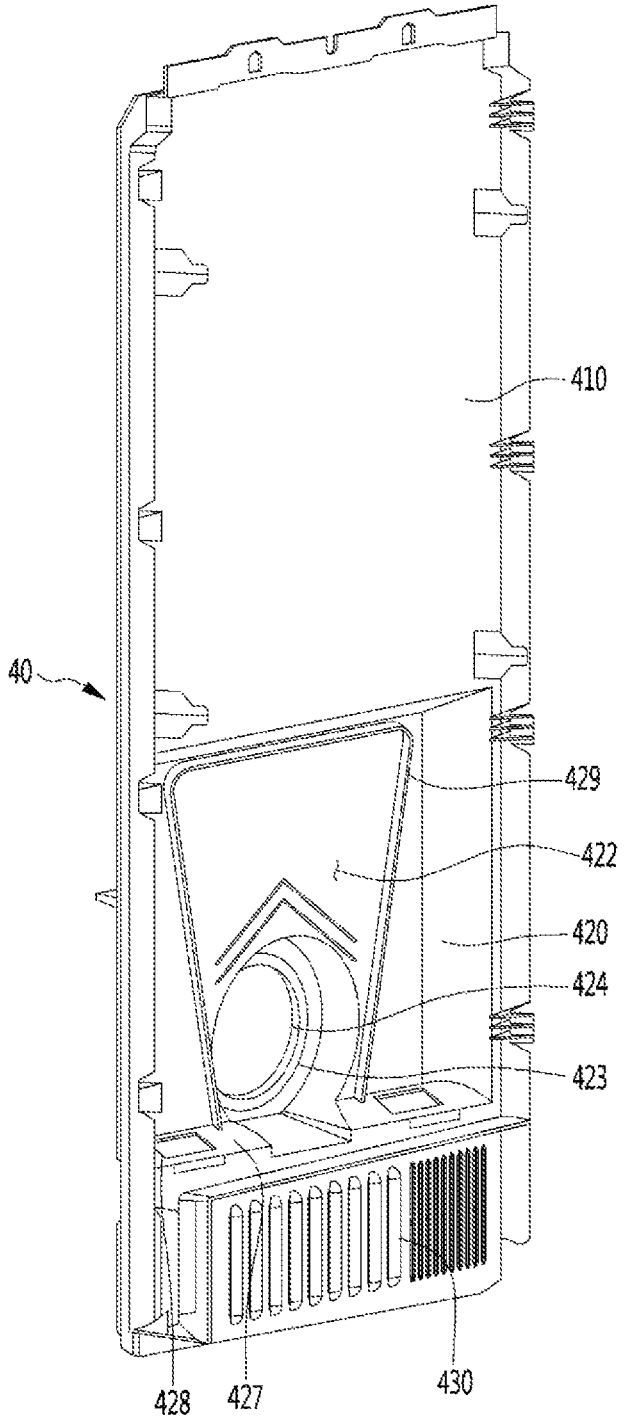
FIG. 9 is a perspective view of the evaporator cover according to an embodiment of the present disclosure.
Figure 10:
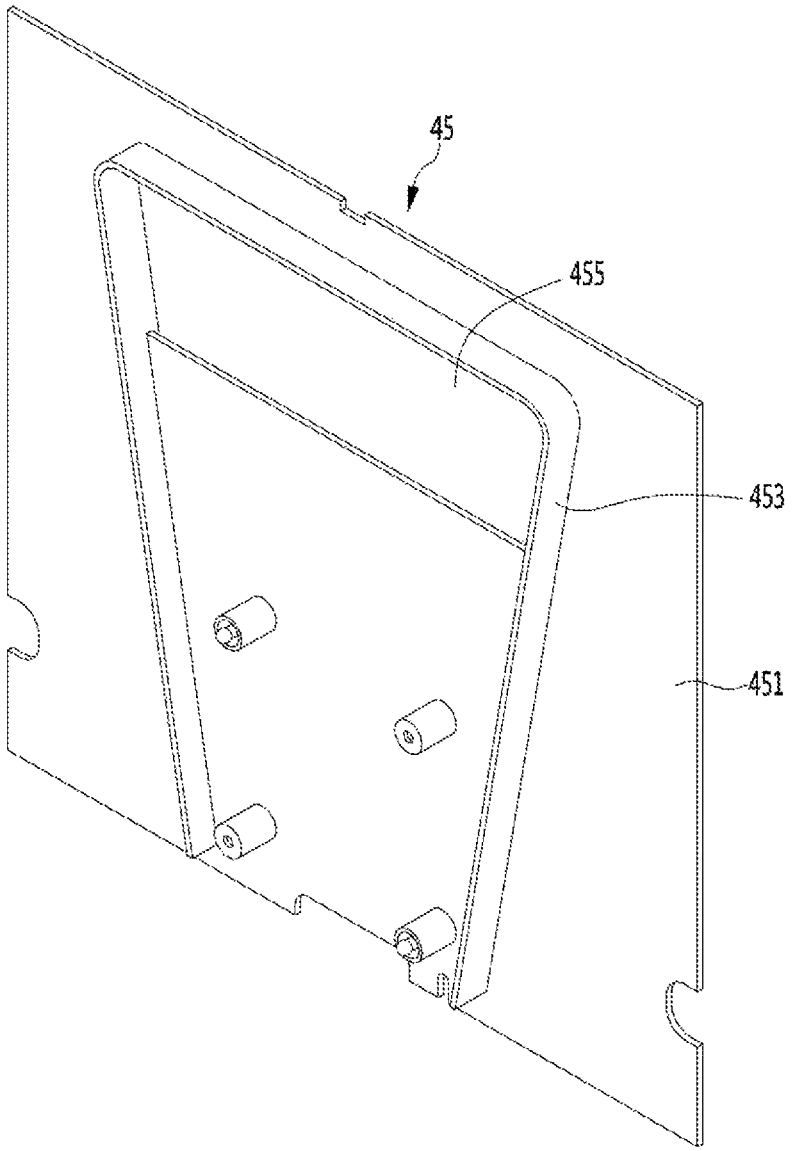
FIG. 10 is a perspective view of a cover member according to an embodiment of the present disclosure.

The front-rear width of the second guide 620 may be larger than the front-rear width of the first guide 610. This is for enabling cold air to smoothly flow from the second guide 620 to the guide passage 440 (see FIG. 11). The second guide 620 may be seated on a passage wall 420 (see FIG. 9) forming a supercooling passage 422 (see FIG. 9) in the evaporator cover 40.

Referring to FIGS. 4, and 9 to 11, the evaporator cover 40 is disposed in the freezer compartment 12 and can cover the front of the evaporator 20. The evaporator cover 40 may include a cover body 410. The cover body 410 may be coupled to the chamber body 22. The passage wall 420 forming a space where the supercooling passage 422 is disposed may be formed on the evaporator cover 40. The passage wall 420 may be recessed away from the evaporator 20, on a portion of the cover body 410. In other words, the passage wall 420 may protrude toward the freezer door 18 from the cover body 410.

A fan receiving part or seat 423 in which the supercooling fan (not shown) can be seated may be formed at the passage wall 420. The fan receiving part 423 may be recessed away from the evaporator 20 at a portion of the passage wall 420. In other words, the fan receiving part 423 may protrude toward the freezer door 18 from a portion of the passage wall 420.

A cold air outlet 424 may be formed at the fan receiving part 423. The cold air outlet 424 may be formed to face the top drawer 13 forming the supercooling compartment 15. For example, the front of the cold air outlet 424 may be positioned to horizontally overlap the top drawer 13 forming the supercooling compartment 15.

The evaporator cover 40 may further have an inlet 430 for guiding the cold air in the freezer compartment 12 to the evaporator 20. The inlet 430 may be disposed under the passage wall 420.

The suction guide 50 for guiding the cold air in the freezer compartment 12 to the inlet 430 may be coupled to the front of the evaporator cover 40. The suction guide 50 not only guides the cold air in the freezer compartment 12 to the inlet 430, but prevents the cold air discharged from the cold air outlet 424 from flowing directly to the inlet 430. With the suction guide 50 coupled to the evaporator cover 40, the top of the suction guide 50 is positioned lower than the inlet 430 and a portion of the suction guide 50 may be declined as it goes to the refrigerator door 18.

The space inside the passage wall 420 may be covered by the cover member 45 (third cover). The cover member 45 covers the space inside the passage wall 420 between the evaporator cover 40 and the evaporator 20. The cover member 45 may include a plate 451. A cold air inlet 455 for receiving cold air that has exchanged heat through the evaporator 20 may be formed at the plate 451.

Ribs 429 and 453 for separate the supercooling passage 422 and the guide passage 440 inside the passage wall 420 may be formed respectively on the passage wall 420 and the cover member 45. The first rib 429 on the passage wall 420 may be formed to surround the fan receiving part 423. The fan receiving part 423 may be disposed in the area defined by the first rib 429. The first rib 429 may be spaced from both sides of the passage wall 420.

The second rib 453 on the cover member 45 may be formed in the same shape as the first rib 429. When the cover member 45 is combined with the evaporator cover 40, the second rib 453 is in contact with the first rib 429. The second rib 453 may be formed the surround the cold air inlet 455. The cold air inlet 455 may be disposed in the area defined by the second rib 453. Alternatively, a rib may be formed on any one of the passage wall 420 and the cover member 45.

Since the second rib 453 on the cover member 45 is formed in the same shape as the first rib 429, the second rib 453 is also spaced from both sides of the passage wall 420. Inside the passage wall 420, the supercooling passage 422 is positioned inside the ribs 429 and 453 and the guide passage 440 is positioned outside the ribs 429 and 453. The guide passage 440 may be positioned at both sides of the supercooling passage 422.

A first hole 426 for passing air discharged from the cold air guide 60 is formed through the top surface 425 of the passage wall 420. Though not limited, a plurality of first holes 426 may be formed through the top surface 425 of the passage wall 420. The first holes 426 may be spaced from each other in the left-right direction of the refrigerator. The first holes 426 may be formed not to vertically overlap the fan receiving part 423 so that air passing through the first holes 426 can flow to the guide passage 440. For example, the first holes 426 may be positioned at both sides on the top surface 425 of the passage wall 420.

A second hole 428 for passing cold air discharged from the cold air guide 440 is formed through the bottom surface 427 of the passage wall 420. Though not limited, a plurality of second holes 428 may be formed through the bottom surface 427 of the passage wall 420. The second holes 428 may be spaced from each other in the left-right direction of the refrigerator. The second holes 428 may be formed not to vertically overlap the fan receiving part 423 so that air passing through the guide passage 440 can flow smoothly through the second holes 428.

The cold air guide 60 may be seated on the top surface 425 of the passage wall 420. When the cold air guide 60 is seated on the top surface 425 of the passage wall 420, the cold air guide 60 covers the first holes 426. Further, the outlet 622 of the cold air guide 60 communicates with the first holes 426. The lateral width of the second guide 620 may be the same as or larger than the distance between the first holes 426 so that the cold air guide 60 can cover the first holes 426.

Referring to FIGS. 10 to 13, the same number of discharge ducts 70 as the second holes 428 may be connected to the evaporator cover 40. The discharge ducts 70 may include a first duct 710 having an inlet 712 and a second duct 720 having an outlet 722 and inclined at a predetermined angle from the first duct 710. The inlets 712 of the first duct 710 communicate with the second holes 428. The first duct 710 may horizontally extend in the freezer compartment 12 and the second duct 720 may extend downward from an end of the first duct 710 in the freezer compartment 12.

Figure 2:
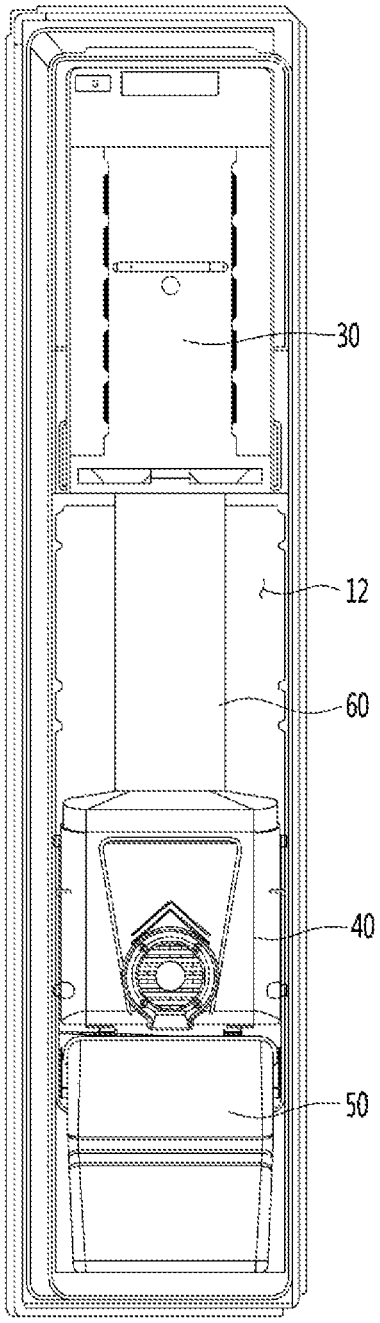
FIG. 2 is a front view showing a freezer compartment according to an embodiment of the present disclosure.
Figure 3:
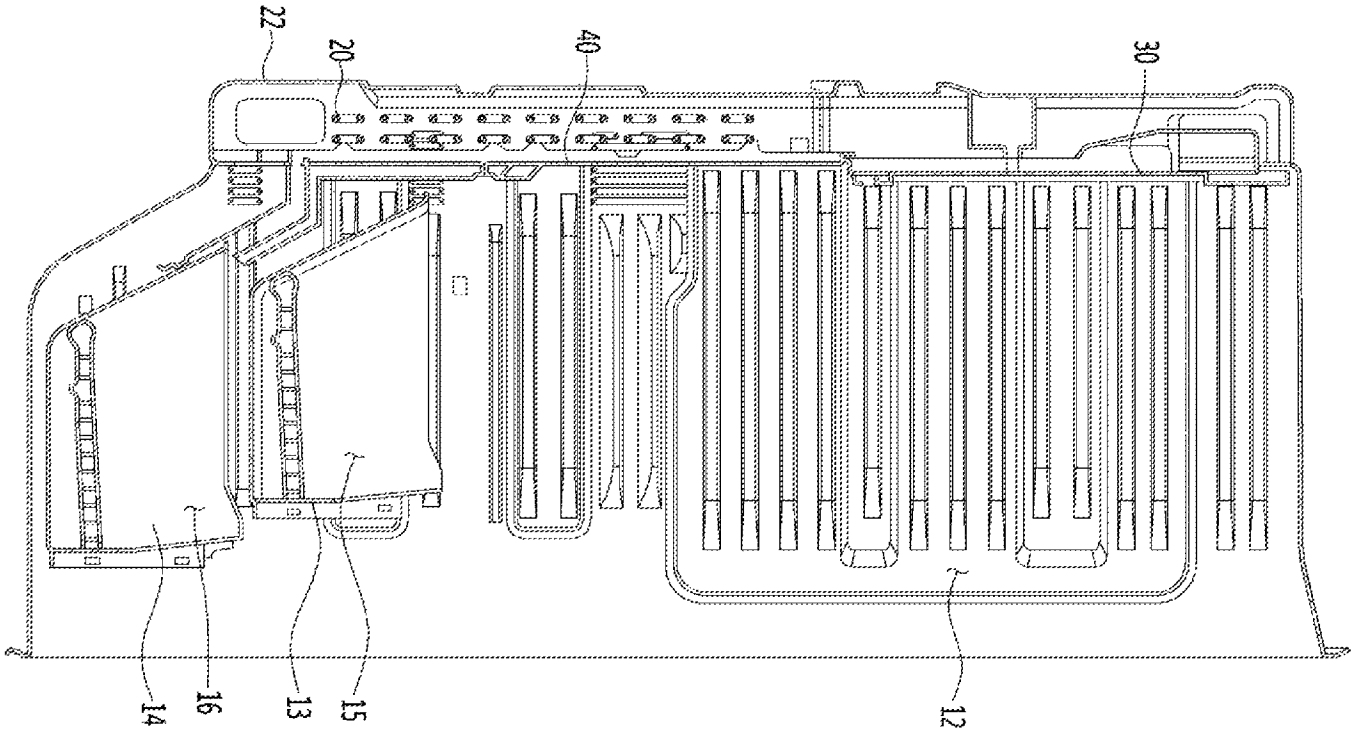
FIG. 3 is a side cross-sectional view showing the freezer compartment according to an embodiment of the present disclosure.
Figure 4:
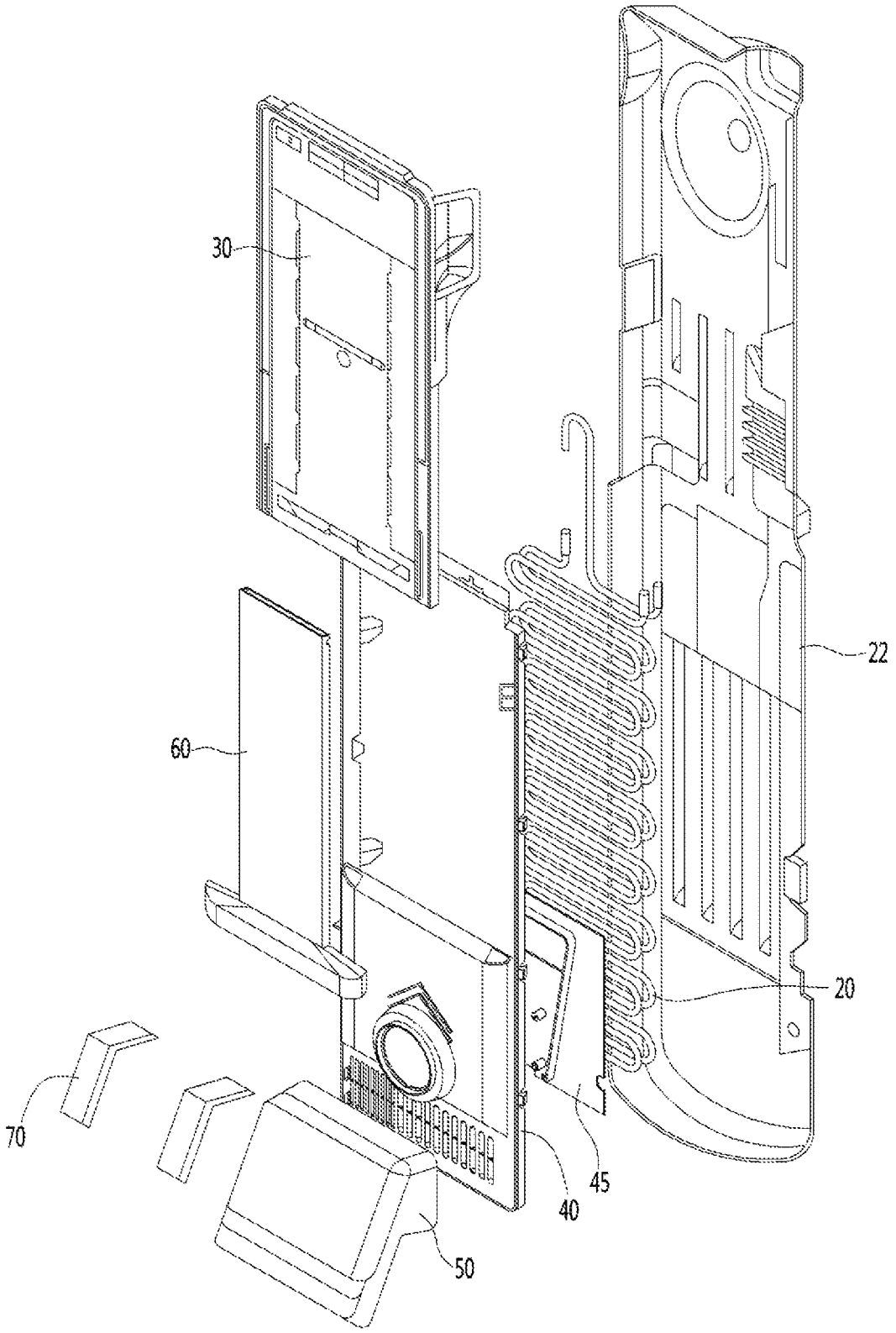
FIG. 4 is an exploded perspective view of a cold air supply mechanism according to an embodiment of the present disclosure.
Figure 14:
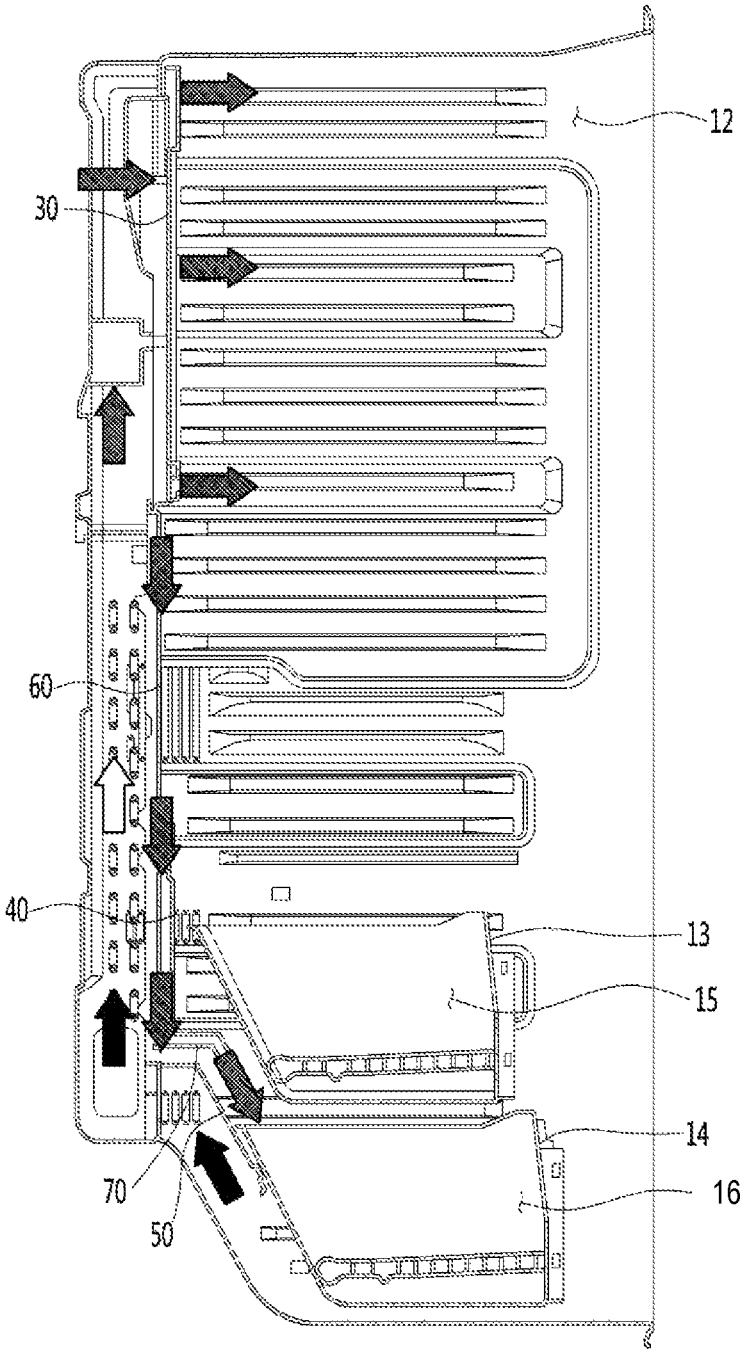
FIG. 14 is a view showing cold air flow in the freezer compartment according to an embodiment of the preset disclosure.

FIG. 14 is a view showing cold air flow in a freezer compartment according to an embodiment of the preset disclosure. Referring to FIGS. 2 and 14, the first ducts 710 are positioned over the suction guide 50 when the discharge ducts 70 are connected to the evaporator cover 40.

The first duct may be positioned between the cold air outlet 424 and the inlet 430. The second duct 720 may extend toward the bottom drawer 14 between the suction guide 50 and the top drawer 13. That is, the second duct 720 may be positioned ahead of the suction guide 50 and behind the top drawer 13.

The outlet 722 of the second duct 720 may be positioned lower than the bottom of the top drawer 13 and higher than the upper end of the bottom drawer 14. The outlet 722 of the second duct 720 may be positioned to vertically overlap the bottom storage space 16 of the bottom drawer 14. According to this structure, it is possible to cold air discharged from the discharge duct 70 from flowing directly to the inlet 430. The lower end of the suction guide 50 is positioned lower than the upper end of the bottom drawer 14.

The flow of cold air in the freezer compartment is described hereafter.

When the fan 312 is rotated by the fan motor 311, cold air in the freezer compartment 12 is sent into the heat exchange chamber through the inlet 430 of the evaporator cover 40 along the suction guide 50 by the torque of the fan 312. The air flowing in the heat exchange chamber exchanges heat through the evaporator 20 while rising.

Some of the cold air that has exchanged heat through the evaporator 20 is sent into the supercooling passage 422 through the cold air inlet 455 of the cover member 45 by rotation of the supercooling fan in the fan receiving part 423. The cold air flowing in the supercooling passage 422 flows through the supercooling fan and is then discharged rearward straight from the supercooling compartment 15 through the cold air outlet 424.

The other of the cold air that has exchanged heat through the evaporator 20 rises and passes through the fan, flows to the cold air passage 320 in the cold air duct 30, and is then discharged to the freezer compartment 12 through the cold air discharge holes.

Further, some of the cold air in the cold air duct 30 is discharged to the cold air guide 60. The cold air discharged to the cold air guide 60 flows downward and keeps flowing to the guide passage 440 through the first holes 426 of the passage wall 420.

The cold air flowing into the guide passage 440 flows downward through the guide passage 440 and keeps flowing to the discharge ducts 70 through the second holes 428. The cold air flowing to the discharge ducts 70 is finally discharged over the bottom drawer 14.

As described above, according to the embodiment, cold air can be smoothly supplied to the top storage space over the supercooling compartment and to the bottom storage space by the cold air guide device. Accordingly, the temperature in the freezer compartment can be uniform.

Further, since the outlet of the discharge duct is positioned over the bottom storage space and the suction guide is positioned behind the bottom storage space, the cold air discharged from the discharge duct can be prevented from directly flowing to the suction guide.

Further, since a portion of the evaporator cover forms the guide passage 440, there is no need for a structure for forming the guide passage 440, so reduction in volume of the freezer compartment can be prevented.

The present embodiment provides a refrigerator that can keep temperature in a freezer compartment uniform.

Further, the present embodiment provides a refrigerator that can smoothly supply cold air to a storage chamber disposed under a supercooling compartment.

A refrigerator according to an aspect of the present disclosure may include a cabinet having a freezer compartment; an evaporator supplying cold air to the freezer compartment; an evaporator cover covering the evaporator and having a supercooling passage for flowing some of cold air that has exchanged heat through the evaporator to a supercooling compartment of the freezer compartment; a cold air duct for flowing the other of the cold air that has exchanged heat through the evaporator to a top storage space over the supercooling compartment; and a cold air guide device for guiding cold air in the cold air duct to a bottom storage space under the supercooling compartment.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items. The same applies to the terms "connected," "coupled," or joined."

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a freezer compartment;

an evaporator configured to supply cold air to the freezer compartment;

an evaporator cover to cover the evaporator and having a supercooling passage for flowing a first prescribed amount of cold air that has exchanged heat through the evaporator to a supercooling compartment of the freezer compartment;

a cold air duct to discharge a second prescribed amount of the cold air that has exchanged heat through the evaporator to a top storage space over the supercooling compartment; and a cold air guide device to guide cold air in the cold air duct to a bottom storage space under the supercooling compartment.

2. The refrigerator of claim 1, wherein the cold air guide device includes:

a cold air guide connected to the cold air duct;

a guide passage communicating with the cold air guide and formed by a portion of the evaporator cover; and a discharge duct communicating with the guide passage and guiding cold air to the bottom storage space.

3. The refrigerator of claim 2, wherein the evaporator cover has a passage wall forming a space where the supercooling passage is provided, and the supercooling passage and the guide passage are separated inside the passage wall.

4. The refrigerator of claim 3, further comprising a cover member coupled to the evaporator cover and covering a space inside the passage wall, wherein a rib separating the supercooling passage and the guide passage is formed on at least one of the passage wall or the cover member.

5. The refrigerator of claim 4, wherein guide passages are formed at both sides of the supercooling passage inside the passage wall.

6. The refrigerator of claim 4, wherein the rib is formed on the evaporator cover and a cold air inlet is formed in an area defined by the rib at the evaporator cover.

7. The refrigerator of claim 3, wherein a bottom discharge hole is formed through a bottom surface of the cold air duct, a first hole is formed through a top surface of the passage wall, and the cold air guide connects the bottom discharge hole and the first hole to each other.

8. The refrigerator of claim 7, wherein a second hole is formed through the bottom surface of the passage wall, and the discharge duct communicates with the second hole.

9. The refrigerator of claim 7, wherein the cold air guide is seated on the top surface of the passage wall and covers the first hole.

10. The refrigerator of claim 9, wherein the cold air guide include:

a first guide having an inlet; and a second guide having an outlet and extending downward from the first guide, and the second guide is larger in width than the first guide, and the outlet communicates with the second hole.

11. The refrigerator of claim 1, wherein the evaporator cover has a cold air outlet for discharging cold air flowing to the supercooling passage and an inlet into which cold air in the freezer compartment flows, and a portion of the discharge duct is positioned between the cold air outlet and the inlet.

12. The refrigerator of claim 11, further comprising a suction guide to guide cold air in the freezer compartment to the inlet, wherein the discharge duct includes:

a first duct having an inlet and provided over the suction guide; and a second duct extending downward from an end of the first duct and having an outlet over the top storage space.

13. The refrigerator of claim 12, wherein the supercooling compartment is defined by a top drawer, the bottom storage space is defined by a bottom drawer provided under the top drawer, a portion of the suction guide is provided behind the bottom drawer, and the second duct is provided ahead of the suction guide and behind the top drawer.

* * * * *